US008297215B1

(12) United States Patent
Chinn

(10) Patent No.: US 8,297,215 B1
(45) Date of Patent: Oct. 30, 2012

(54) GATE STANCHION BOARDING LADDER FOR SAILBOATS

(76) Inventor: Clayton D. Chinn, Oakland, CA (US)

( * ) Notice: Subject to any disclaimer, the term of this patent is extended or adjusted under 35 U.S.C. 154(b) by 0 days.

(21) Appl. No.: 12/924,643

(22) Filed: Oct. 1, 2010

(51) Int. Cl.
*B63B 17/00* (2006.01)

(52) U.S. Cl. ..... 114/362

(58) Field of Classification Search ..... 114/362
See application file for complete search history.

(56) References Cited

U.S. PATENT DOCUMENTS 2,971,601 A 2/1961 Fortune
3,862,670 A 1/1975 Hovey
3,892,290 A 7/1975 Lang
4,547,164 A * 10/1985 Coles et al. ..... 441/84
4,562,786 A * 1/1986 Pruonto ..... 114/61.22
4,724,925 A 2/1988 Ritten
4,823,910 A 4/1989 Day
5,117,940 A * 6/1992 Garelick ..... 182/97
5,628,274 A * 5/1997 Biedenweg et al. ..... 114/362
5,704,447 A 1/1998 Doyle
7,585,197 B1 9/2009 Merten

* cited by examiner

*Primary Examiner* — Edwin Swinehart

(57) ABSTRACT

A folding boarding ladder, integrated with, and stored within, a sailboat's gate stanchion. Designed for dock-to-deck access, the invention is unobtrusive and presents a minimal wind profile. Permanently mounted at the lifeline gate, the ladder is always accessible, and may be used while docking and casting off.

4 Claims, 3 Drawing Sheets

GATE STANCHION BOARDING LADDER FOR SAILBOATS

U.S. Classification 114/362, Boat Boarding Aids.

The following is a list of prior art cited herein:

U.S. Pat. No. 2,971,601 Feb. 14, 1961 William J. Fortune
U.S. Pat. No. 3,862,670 Sep. 25, 1973 Cecil C. Hovey
U.S. Pat. No. 4,724,925 Feb. 16, 1988 Robert G. Ritten
U.S. Pat. No. 4,823,910 Apr. 25, 1989 Roger P. Day
U.S. Pat. No. 3,892,290 Jul. 1, 1975 Irving M. Lang
U.S. Pat. No. 5,704,447 Jan. 6, 1988 David A. Doyle
U.S. Pat. No. 7,585,197 Sep. 8, 2009 C. William Merten

BACKGROUND OF THE INVENTION

Leisure sailing has never been more affordable and comfortable, as designers have refined composite construction techniques to craft sailboats with ever more spacious and luxurious cabins.

But as cabin headroom has grown, so too has freeboard, the height of the main deck over the waterline. Higher freeboard is problematic in only one significant way; it can be much harder to climb aboard.

From floating dock to main deck, many larger sailboats require a climb of over 30 inches, the functional equivalent of stepping onto a moving dining room table. While this is presumably effortless for the captain and experienced crew, with a pitching deck and a water gap, this climb may be a daunting task for younger, older, or less athletic passengers.

Additionally, lifelines, a system of wire rope railings and stanchions installed on most sailboats, tend to impede boarding. To avoid this problem, most boat designers now incorporate one reinforced gate stanchion on each side of the boat, allowing lifelines to be selectively opened for passenger boarding, while maintaining full function of all other lifelines. Gate stanchions are generally crafted from stainless steel tubing, and are commonly shaped like a lower case "h", or an inverted upper case "U," to offer longitudinal support when the lifeline gate is opened.

In brief, the present invention is a combination gate stanchion and boarding ladder assembly, ideal for use on sailboats. The ladder is folded and stowed within the gate stanchion, so as to be unobtrusive to normal sailboat function. The invention offers the advantages of a permanent and secure, folding boarding ladder, mounted directly adjacent the lifeline gate, deployable for docking and casting off, and immediately accessible from deck or dock.

While there is a considerable body of prior art for boarding aids, discussed below, very few relate to this invention. Prior art reveals no boat stanchion that integrates a ladder, no ladder attached to a stanchion, and no ladder stowable within a stanchion.

DISCUSSION OF PRIOR ART

Dock stairs, perhaps one of the most ancient boarding devices, are still in extremely wide use for sailboats to this day. Usually manufactured from plastic or fiberglass, or home-built from wood, they often lack handrails, and present the discomforting scenario of requiring the user to climb to height before taking the most dangerous step, the step onto a rocking boat. Worse yet, as dock stairs are not truly portable, in the sense of being readily moveable from one port to another, at the end of a journey, stairs may not be available at another port.

Folding stairs or ladders, generally made of metal, are a less common but portable alternative. Like dock stairs, they often lack handrails, and as they rely on a smaller base of support, they can be unstable on weathered and warped docks. While transportable, folding stairs or ladders are often quite bulky, and consume valuable space below deck. Perhaps the most basic flaw, however, lies in the fact that it is difficult to simultaneously cast off and board with a ladder, and almost impossible to disembark with a ladder while handling mooring lines.

Many boat-mounted folding ladders are evident in prior art, but the vast majority are stern-mounted swim ladders, generally for leisure motorboats or ski boats, which have swim platforms or otherwise sit close to the water, such as U.S. Pat. Nos. 2,971,601 (Fortune) and 3,862,670 (Hovey). None appear suitable to gunwale-mounting on sailboats, as they would either obstruct the flow of water around the hull, or impede movement on deck.

In contrast to motorboats, most sailboats feature high freeboard along the length of the hull, which is submerged when heeling, the leaning caused by wind in the sails. Above board, sailboat decks are very nearly flush to the gunwales, and are kept sleek and spare, as projections and irregular surfaces hinder crew movement on deck, and cause undesirable turbulence that reduces boat speed. Prior art reveals no boat-mounted folding ladders that would accommodate heeling, while leaving the deck unimpeded.

Very few patents specifically contemplate boarding ladders for sailboats, and all are designed to be swim ladders. U.S. Pat. Nos. 4,724,925 (Ritten) and 4,823,910 (Day) are permanently stern-mounted to avoid water contact when heeling, and thus are poorly positioned for dock access. U.S. Pat. No. 3,892,290 (Lang) is gunwale-mounted, and could conceivably be used for dock access, but the invention is large and would require removal and storage before sailing.

As applied to sailboats, all boarding ladders tend to suffer these three aforementioned shortcomings to varying degrees; 1) they are stern-mounted and unsuitable for dock access, 2) they are permanently gunwale-mounted, and either obstruct water flow or impede movement on deck, or 3) they are gunwale-mounted and removable, which both necessitates inboard storage and decreases ladder accessibility.

Many manufacturers offer removable, easily stowable, rope ladders with solid rungs. These venerable designs are excellent as emergency man-overboard ladders, and there are some modern iterations such as U.S. Pat. Nos. 5,704,447 (Doyle) and 7,585,197 (Merten). However, by the nature of their design, rope ladders are inherently unstable.

Prior art reveals no permanent, gunwale-mounted, folding, dock access boarding ladder suitable for sailboats. Moreover, prior art reveals no folding ladder attached to a stanchion, no stanchion that integrates a ladder, and no ladder stowable within a stanchion.

SUMMARY OF THE INVENTION

The preferred embodiments reveal a permanently mounted, folding boarding ladder, integrated with and stowable within a gate stanchion. The folding ladder is designed for easy dock access, and is ideal for use on a sailboat. The invention is inconspicuous, and is conveniently mounted directly adjacnet the lifeline gate. The ladder may be used with or without opening the lifeline gate, and if opened, the invention assures that all other lifelines retain their full safety function.

By virtue of its stowability within the space of a gate stanchion, the invention is visually unobtrusive, permits normal function and free movement on deck, and presents minimal wind resistance. Easily internally stored, the invention neither obstructs movement on deck nor consumes storage space.

Moreover, by virtue of permanent gunwale-mounting, the invention is a traveling boarding ladder, moving with the boat, and stable and secure in offering a two-handed grip. The invention can be deployed for docking and casting off, and is always immediately accessible from deck or dock.

The invention transfers the user's weight directly to the very sturdiest parts of a sailboat, and requires no deck reinforcement. As such, the invention may be mounted in new boat construction or retrofitted to existing boats

DRAWINGS

Figures

The drawings herein depict two of many possible embodiments of the invention. All identical parts are identified by the same reference numbers herein. As both embodiments are bilaterally symmetrical, parts may be identified by reference numbers on one side only.

DRAWINGS

List of Reference Numbers

Figure 1:
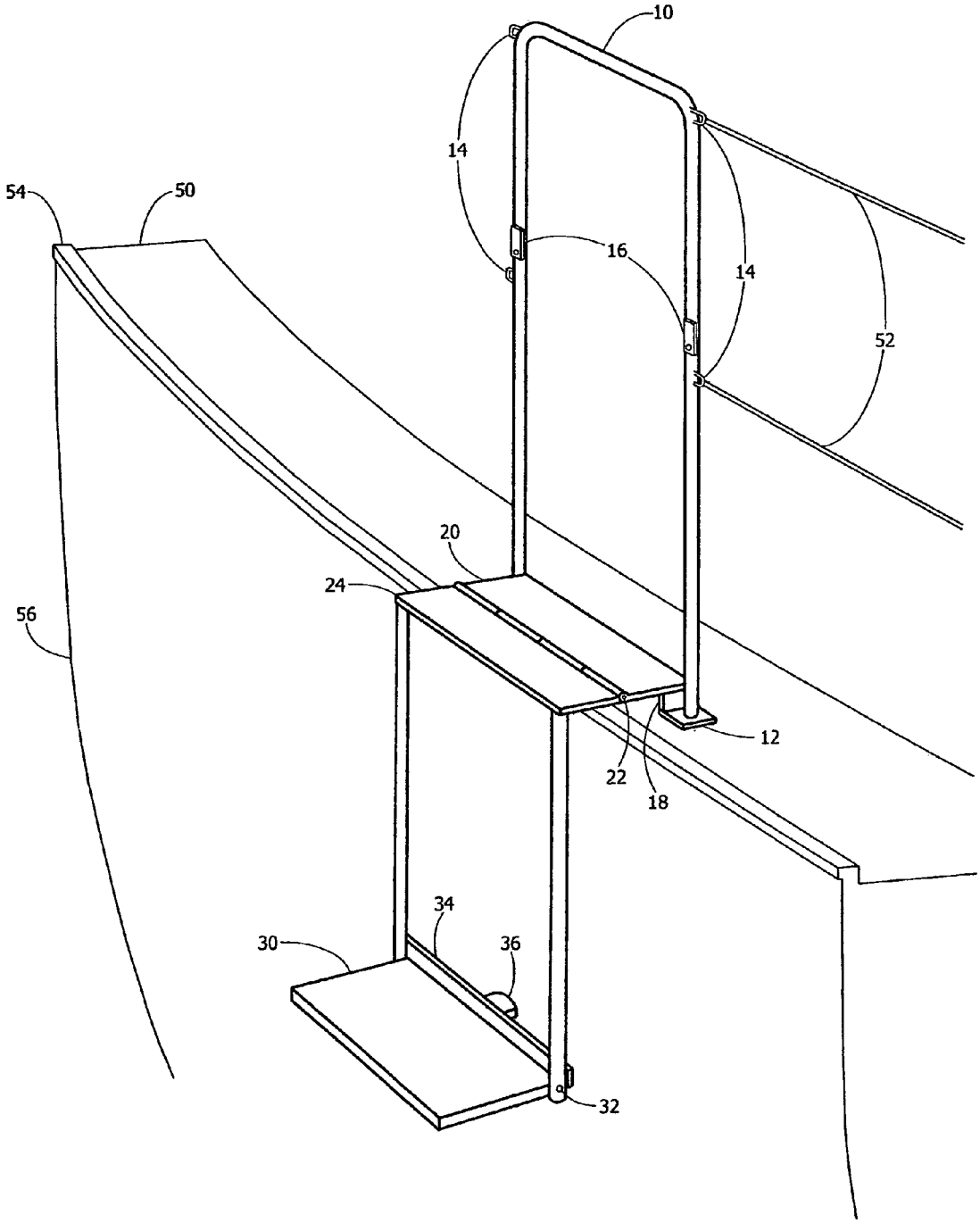
FIG. 1 is a perspective view of the first embodiment, lowered and ready for use.

Parts Common to the First and Second Embodiments

10 stanchion
12 stanchion bases
14 lifeline attachment eyes
16 latches
18 hinge plate riser
20 inboard hinge plate
22 hinge pin
24 outboard hinge plate
26 urethane padding
28 ladder risers Parts Unique to the First Embodiment

30 lower step
32 lower step hinge pin
34 lower step toe rail
36 bumper Select Parts of a Typical Sailboat

50 deck
52 lifelines
54 gunwale
56 hull

Parts Unique to the Second Embodiment

70 ladder risers
72 upper cross member
74 lower cross member
76 upper tread plate
78 lower tread plate
80 bumpers

Descriptions and Operations

FIG. 1 is a perspective view of the first embodiment, lowered and ready for use. For clarity, a partial view of a boat is included to illustrate the orientation of the invention.

An inverted "U" shaped stanchion 10 is mounted to the deck 50 of the boat with a welded stanchion base 12 on each side. The stanchion 10 is outfitted with four lifeline attachment eyes 14, for the support of lifelines 52. The stanchion 10 is also outfitted with two pivoting latches 16, here shown in the open position, which secure the invention when stowed.

Hinge plate risers 18 are welded to the stanchion bases 12 between the sides of the stanchion 10, such that the top of the risers 18 are slightly higher than the gunwale 54. An inboard hinge plate 20 is welded to the risers 18 parallel to the deck 50, such that the hinge pin 22 faces, but does not extend over the gunwale 54. An outboard hinge plate 24, is attached to the hinge pin 22 such that the lateral edge of the outboard hinge plate 24 extends over the gunwale 54, but may also be folded over the inboard hinge plate 20. Unfolded, the hinge plates 20 & 24 effectively form the top step of the ladder. A thin urethane pad 26 (not shown in FIG. 1, but visible in FIG. 2) is attached to the outboard hinge plate 24 to allow the user's weight to be transferred to the gunwale 54 without causing wear.

Two downwardly projecting ladder risers 28 are welded to the outboard hinge plate 24, just outside the gunwale 54, such that the ladder risers 28 fit between the sides of the stanchion 10 when the outboard hinge plate 24 is rotated. A lower step 30 is attached between the lower ends of the ladder risers 28 by a lower step hinge pin 32. A lower step toe rail 34 is attached to the top of the lower step 30 on the hull side 56 of the ladder risers 28, to prevent over-rotation of the step 30, and to provide tactile feedback for users. A urethane bumper 36 is attached to the center of the toe rail 34, between the toe rail 34 and the hull 56 to keep the ladder risers 28 parallel to the stanchion 10, and to prevent wear on the hull 56.

While the drawing depicts the lifelines 52 detached from the left-side lifeline attachment eyes 14, note that the ladder assembly of the invention is fully functional with or without the lifelines 52 attached. Many experienced sailors are accustomed to stepping over lifelines 52 to board, and may elect to use the invention without detaching the lifelines 52.

In use, note that the stanchion 10 offers a secure, two-handed grip. It has been observed that most users prefer a cantilevered lower step 30, and feel comfortable with a distance of up to 16 inches between the step formed by the hinge plates 20 & 24 and the lower step 30. As such, this embodiment would be suitable for most sailboats in the 30 to 40 foot range.

Note that the first embodiment is specifically designed to transfer a user's weight to the gunwale 54, one of the strongest parts of a boat. Even standing on the lower step 30, the user's weight is supported almost entirely by the gunwale 54, with minor pressure on the hull 56, and with virtually no force on the stanchion bases 12. As such, the deck 50 would not require additional reinforcement or stanchion bedding for the installation of this invention.

FIG. 2 is a perspective view of the first embodiment, raised and stowed. For clarity, a partial view of a boat is included to illustrate the orientation of the invention.

To fold the invention, the lower step 30 is rotated parallel to, and between, the ladder risers 28. The lower step 30 and ladder riser 28 assembly is rotated upward to nest between the sides of the stanchion 10. If more convenient, these two procedures may be reversed, or performed concurrently. Once in place, the two pivoting latches 16 are rotated into a lowered position, constraining the lower step 30 and ladder riser 28 assembly within. Deploying the invention is the reverse of folding the invention.

Note that when folded, the invention is no larger than a standard gate stanchion, and neither impedes sails, lines, nor crew.

FIG. 3 is a perspective view of the second embodiment, using multiple steps in a more traditional ladder configuration, lowered and ready for use. For clarity, a partial view of a boat is included to illustrate the orientation of the invention.

Figure 2:
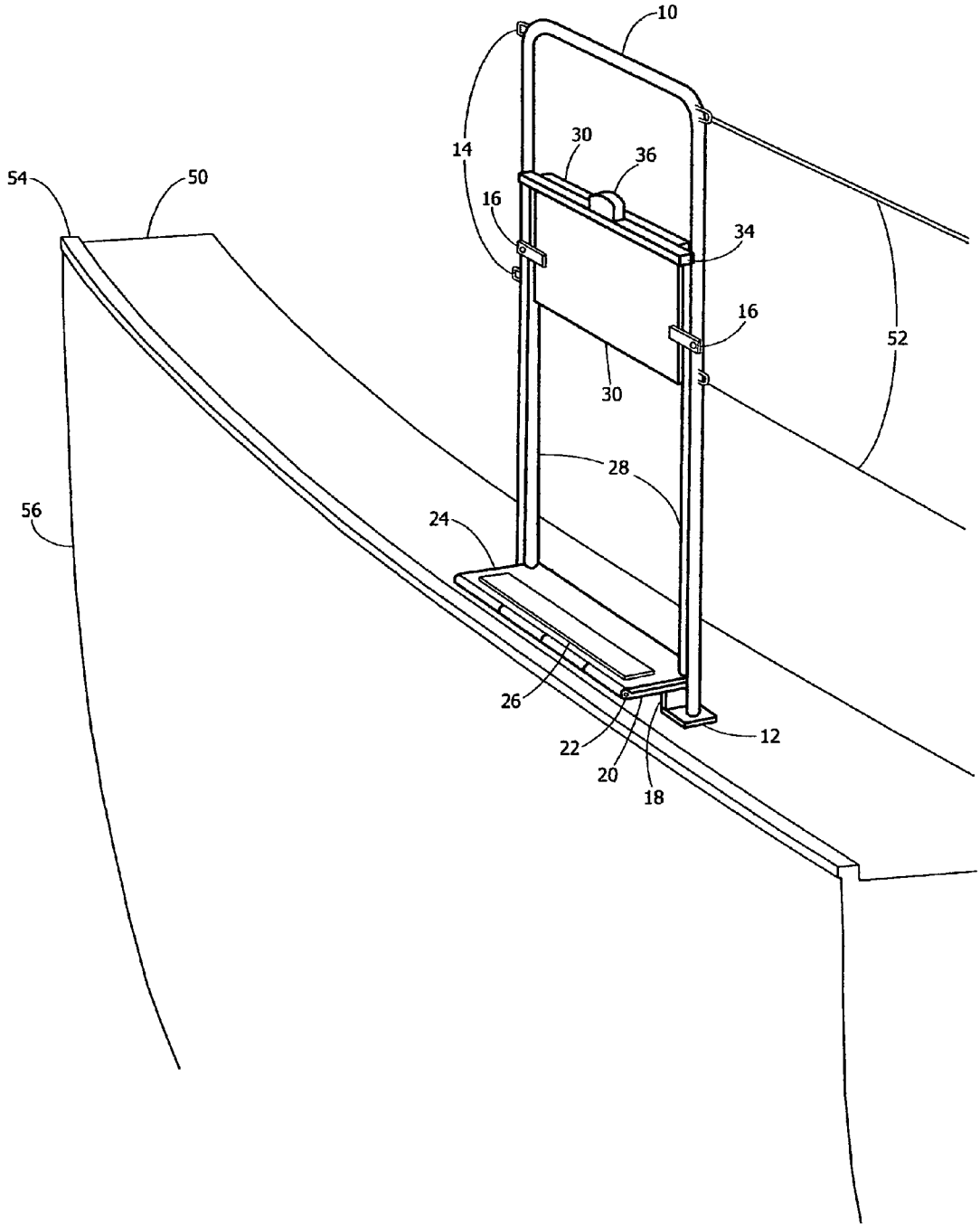
FIG. 2 is a perspective view of the first embodiment, raised and stowed.
Figure 3:
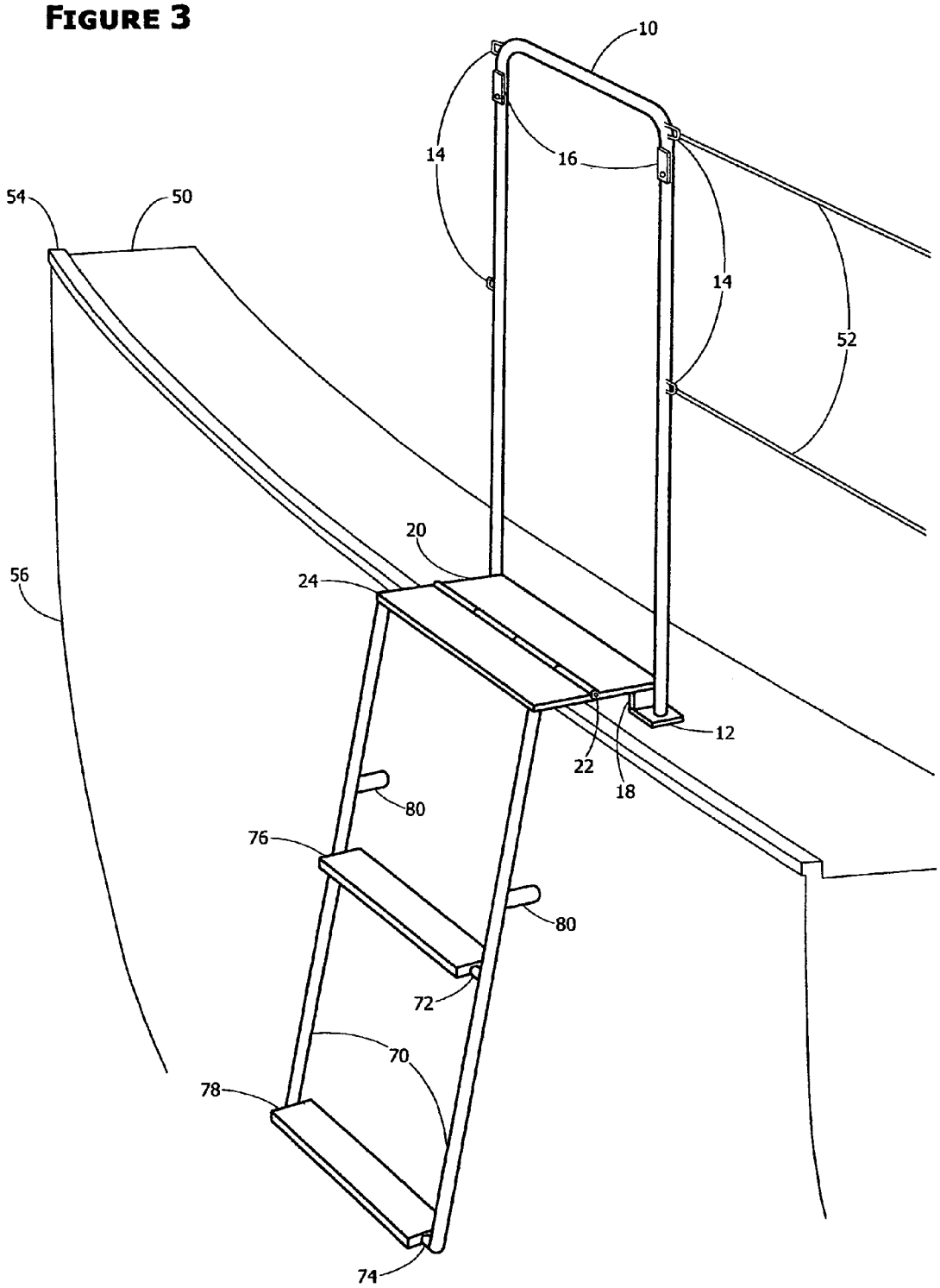
FIG. 3 is a perspective view of the second embodiment, lowered and ready for use.

As many parts of the first and second embodiments are identical, paragraphs two and three of the Description for FIG. 1 are incorporated herein by reference.

Two downwardly projecting ladder risers 70 are welded to the outboard hinge plate 24, just outside the gunwale 54, such that the ladder risers 70 fit between the sides of the stanchion 10 when the outboard hinge plate 24 is rotated. Two cross members 72 & 74 are welded on the ladder risers 70 at equal distances, to form rungs like a traditional ladder. Molded plastic tread plates 76 & 78 are mounted on the cross members 72 & 74. Two urethane bumpers 80 are attached to the ladder risers 70 to support the ladder risers 70 at an angle of approximately 75 degrees to the water when lowered, and to prevent wear on the hull 56.

While the drawing depicts the lifelines 52 detached from the left-side lifeline attachment eyes 14, note that the ladder assembly of the invention is fully functional with or without the lifelines 52 attached. Many experienced sailors are accustomed to stepping over lifelines 52 to board, and may elect to use the invention without detaching the lifelines 52.

Note that this embodiment allows for a total of three steps, and assuming the stanchion 10 stands 24 inches high, the lowest step would reach approximately 21 inches below the gunwale 54. As such, this embodiment would be suitable for most sailboats in the 45 to 60 foot range.

Note that the second embodiment is designed to transfer a user's weight to the gunwale 54 and hull 56. Very little force is applied to the stanchion bases 12. As such, the deck 50 would not require additional reinforcement or stanchion bedding for the installation of this invention.

Scope and Definitions

While many specificities are used throughout this document, and in the drawings and descriptions, these specificities should not be construed as limitations on the scope of the invention, but as exemplifications of the presently preferred embodiments allowable under the claim.

As used throughout, the term "invention" refers not only to the preferred, described or depicted embodiments, but to all alternative embodiments allowable under the claim.

As used throughout, the terms "stanchion" and "gate stanchion" are used interchangeably to refer to all lifeline supports along the gunwale where the lifeline may be opened, detached, lowered or removed, including but not limited to lifeline terminals and the gunwale section of a wrap-around stern rail.

As used throughout, the term "folding ladder" refers to ladders or stairs, or any combination thereof, which may or may not fold at the mounting and/or the risers, and may be made telescoping or otherwise extensible.

As the invention is primarily designed for sailboats, the term "sailboat" is used throughout. However, said term should not be construed as a limitation on the scope of the invention, but as preferred embodiments allowable under the claim.

Alternative embodiments include, but are not limited to the following. The stanchion assembly may differ in design, shape, size, support and mounting. The lifeline attachments may be eyes or through-holes, and may differ in design, location, and shape. The stanchion assembly and the ladder assembly may be attached by different means, methods, designs and locations, may be detachable, or may be physically unattached but designed in close proximity such as to obscure, hide or minimize visibility of the ladder assembly. The ladder assembly may or may not be physically separate from the stanchion, may be made to fold in a different manner, made telescopic or otherwise extensible, made into a swim ladder, made to lock into a folded or unfolded position, made larger or smaller, or made of more or less parts. The ladder may have one riser, or a plurality of risers. The number of steps may differ, and the step assemblies may fold or not fold, may fold in a different manner, may be made to lock in a folded or unfolded position, may be unfolded by means of a spring, may differ in design and shape, and may project outward like stairs, or downward like rungs in a ladder, or any combination thereof. The attachment of any and all parts may be accomplished by different means and methods, and all parts may be attached at different locations. All parts and materials may differ in size, shape, thickness, composition and number, and parts may be added and/or removed from the design.

Accordingly, while this invention relates primarily to the functional and aesthetic aspects of a gate stanchion boarding ladder for sailboats, the scope of the invention shall not be determined by the examples herein stated, as myriad variations are possible within the parameters of the claims of invention.

Advantages and Conclusions

Boat designers have always sought to carry the fluid lines of a set of sails into the form and function of a fast, sleek and well-appointed sailboat. Herein is presented a complementary, graceful and unobtrusive boarding aid.

It seems plainly incongruous that most owners of pleasure yachts are forced to rely on non-transportable dock stairs, or awkward folding metal ladders. Away from home port, more than a few have been embarrassed to watch their less athletic friends resort to the sit-and-scoot method of boarding.

The subject invention is a folding boarding ladder, inconspicuously incorporated into a gate stanchion. As would be expected, both elements perform their normal functions. The ladder may be used with or without the lifeline gate open, and all lifelines retain their full safety operation when the lifeline gate is open. However, taken together, the advantages of the invention extend well past prior art in either field.

Under sail, the invention is ingeniously stowed to consume neither deck space, nor storage space. It allows the free and unimpeded movement of sails, lines and crew, and has a very minimal wind profile.

The invention is permanently-mounted to each side of the boat, and the ladders are internally stored within fully functioning gate stanchions. As such, a ladder is always immediately available for use, whether docking on port or starboard. It cannot be left in storage, or left on the wrong side of the boat; the invention waits directly at the lifeline gate.

Deployment of the ladder is clear, even to first-time users, as it is held fast by simple and apparent rotating latches. The ladder is within easy reach, and may be raised or lowered, from on board, or from the dock.

In use, the ladder is intuitive, natural, and stable. As the ladder moves with the boat, the first step puts the user firmly in synchrony with the boat. The athletically inclined will step on or off in two easy strides, bypassing the top step. More cautious guests will find the stanchion offers a secure two-handed grip, and may choose to climb on and off facing the ladder.

Experienced crew will find the ladder most advantageous during the casting off and docking procedures. As the ladder sits higher than floating docks, and moves with the boat, crew may help walk the boat out of the berth and readily step aboard. On returning to port, with mooring lines in hand, crew may avoid a precarious leap from deck to dock.

In use, the ladder transmits virtually all the force of a user's weight directly to the gunwale and hull, the very strongest parts of any boat. The invention produces insignificant mechanical stress, and does not require any support or reinforcement.

Finally, the invention can be crafted to conform with the bolt patterns of existing gate stanchions, so boat manufacturers need not re-tool their designs, and boat owners may easily retrofit the invention.

While the art of sailing is rooted in antiquity, modern leisure sailing is a newer pastime, far more comfortable and convenient than could have been imagined in the past. But to this time, modern sailboat owners have lacked a truly portable, immediately accessible, means to board from a dock.

As revealed herein, the invention, a gate stanchion boarding ladder for sailboats, integrates fixtures and accessories into novel form and function, producing significant advantages unrecognized by, and extending beyond, all prior art.

The invention claimed is:

1. A boat boarding aid, comprising:

a) two vertical, elongate members, of a length to support a desired height of lifelines, and, b) one elongate, transverse member extending between and connecting said vertical members at a top end of each vertical member, and, c) attachment means by which each lower end of said vertical members may be fastened to a deck of a boat, and, d) first detachable attachment means by which lifelines may be connected to said vertical members, such that lateral and longitudinal forces on said lifelines are distributed, by said connected vertical and transverse members and attachment means, to the deck of said boat, and, e) a ladder, comprising one or more ladder risers connected to one or more ladder rungs, and, f) hinged means for joining said vertical members' deck attachment means, to said ladder, such that said ladder may be swung up and stowed adjacent to said assembled vertical and transverse members, or may be swung down toward the hull of said boat for use, and, g) second detachable attachment means for securing said ladder in the stowed position, and for releasing said ladder for use, whereby said connected vertical and transverse members work in conjunction as a gate stanchion or lifeline terminal, providing sufficient structural rigidity to safely support attached lifelines in the event adjacent lifelines are released, and, whereby, when said ladder is lowered for use, said transverse member serves as a handrail for said ladder, and, whereby, when said ladder is lowered for use, an individual boards said boat by climbing said ladder, by stepping around said vertical and transverse members, and by passing through or over a lifeline gate, and, whereby, when stowed, said ladder is compact, inconspicuous, presents minimal wind resistance, and impedes neither lines nor crew, and, whereby said ladder is convenient and always readily accessible for boarding.

2. A boat boarding aid as recited in claim 1, wherein said ladder rungs are connected to said ladder risers by hinge mechanism, whereby when lowered, said rungs may unfold outward into a stair configuration.

3. A boat boarding aid as recited in claim 1, wherein said hinged means is configured such that, when said ladder is lowered, said hinged means forms a substantially planar, horizontal surface, whereby said surface may be used as a step when the ladder is lowered for use.

4. A boat boarding aid as recited in claim 1, wherein said hinged means is detachable, whereby said ladder assembly may be removed from said vertical and transverse members to absolutely minimize wind resistance.

* * * * *